United States Patent [19]

Long et al.

[11] Patent Number: 4,782,670

[45] Date of Patent: Nov. 8, 1988

[54] DUAL HOT-COLD MAINTENANCE CONTAINER

[76] Inventors: Timothy S. Long; Kimberly T. Long, both of P.O. Box 1041, Chico, Calif. 95927

[21] Appl. No.: 166,192

[22] Filed: Mar. 10, 1988

[51] Int. Cl.[4] ..... F25D 3/08

[52] U.S. Cl. ..... 62/457; 62/430; 62/530; 165/80.5

[58] Field of Search ..... 62/457, 529, 530, 430; 165/80.5

[56] References Cited

U.S. PATENT DOCUMENTS

| | | | |
|---|---|---|---|
| 2,876,634 | 3/1959 | Zimmerman et al. | 62/530 X |
| 3,463,140 | 8/1969 | Rollor, Jr. | 62/457 X |
| 3,680,330 | 8/1972 | Canosa | 62/457 |
| 3,715,895 | 2/1973 | Devlin | 62/457 |
| 4,183,226 | 1/1980 | Moore | 62/457 |
| 4,299,100 | 11/1981 | Crisman et al. | 62/457 |
| 4,324,111 | 4/1982 | Edwards | 62/530 X |
| 4,357,809 | 11/1982 | Held et al. | 62/457 |
| 4,570,454 | 2/1986 | Campbell | 62/457 |
| 4,741,176 | 5/1988 | Johnson et al. | 62/457 |

*Primary Examiner*—Lloyd L. King

[57] ABSTRACT

An insulated beverage container having both hot and cold retention capabilities designed for the purpose of maintaining, increasing, or decreasing the temperature of the contents in the container. The plastic structure of the container, an insulating sleeve between duel walls of the container, and encapsuled between the dual walls, a thermoplastic gel capable of retaining heat as well as cold, produces a multi-action container which can be heated in a microwave oven, a conventional oven, or can be frozen in a freezer. The hot-cold embodiment is available in the form of pitchers as well as cups and mugs and is also dishwasher safe. A second styrofoam embodiment of the invention structured as a can or bottle holder has inner walls containing a cold insulation medium which can be refrigerated or frozen and is designed to maintain or decrease the temperature of the contents in the held can or bottle for prolonged periods of time.

10 Claims, 3 Drawing Sheets

DUAL HOT-COLD MAINTENANCE CONTAINER

BACKGROUND OF THE INVENTION

1. Field of the Invention

This invention relates to insulated containers, and more precisely to liquid beverage containers with both hot and cold temperature maintenance capabilities.

2. Description of the Prior Art

Past art patents were examined from a search conducted on the following classes and subclasses:

62/457, 530, and 529.

The patents which were found to be most pertinent to my invention included:

A patent issued to Zimmerman et al, dated March 10, 1959, U.S. Pat. No. 2,876,634, illustrates a container for rapid cooling of heated materials to a specific point then maintaining that temperature for an extended time.

U.S. Pat. No. 3,359,756, dated Dec. 26, 1967, issued to Mirguet, shows a jug with an incorporated ice cube retainer system.

Rollor, Jr. was issued U.S. Pat. No. 3,463,140, on Aug. 26, 1969, for a container for heated liquids which is also designed to cool the contents of the container to a certain degree and then maintain that temperature.

On Aug. 1, 1972, Canosa was issued U.S. Pat. No. 3,680,330, for a cooling vessel for beverages.

U.S. Pat. No. 3,715,895, was issued to Devlin on Feb. 13, 1973, for "Drinking Cup For Freezing A Beverage To A Slush-Like Condition".

A patent issued to Moore on Jan. 15, 1980, Pat. No. 4,183,226, illustrates a canned or bottled beverage holder with an internal refrigerant.

On Apr. 13, 1982, U.S. Pat. No. 4,324,111, was issued to Edwards for a "Freezing Gel Containment Structure And Method".

Held et al. was issued U.S. Pat. No. 4,357,809, on Nov. 9, 1982, for a cooling arrangement including a gel medium. The gel will also maintain a heated beverage for a time but the gel cannot be heated, it must remain at room temperature.

To my knowledge, the previously mentioned patents represented devices most pertinent to my invention. Although several devices seen in past-art patents and in the market place are designed to cool or to heat the contents of their containers, none were found which did both. Having one cup which can interchangeably function with both hot and cold capabilities is an obvious advantage over one that has only one function. Only one invention, seen in U.S. Pat. No. 4,357,809, was found which suggested having a partial heating quality along with cooling capabilities. The insulating medium used in the invention must remain at room temperature. It was not designed to be heated having only minor heat retention capabilities, and the container definitely is not intended to increase the temperature of the contents as can my device.

Another problem found with the devices shown in past art U.S. Pat. Nos. 2,876,634 and 3,359,756, was that although they are designed to maintain and prolong the temperature of the contents for an extended time period, they were not designed to increase or decrease the temperature. If the contents poured into the container were, for example, warmer than desired such as with a warm beer, most of the past art devices have only the ability to maintain that undesirable temperature, not to decrease it.

There is no mention in the past art patents as to the specific device being machine washable, or microwavable, as is my device. Still other past art devices have insulating mediums that have a tendency to "slosh" around inside the container creating an annoying noise and having a tendency to cause the container to tip over easily, and overall, giving the container an effect other than that of a normal cup or mug.

Other devices, such as shown in Pat. Nos. 2,876,634, 3,359,756, and 3,680,330, do not insulate the outer surfaces of the containers from the heat or cold of the contents nor do they eliminate the problem of condensation on the outer surface when holding a cold beverage, except for U.S. Pat. No. 3,680,330 which has a condensation collection tray on the bottom edge of the device.

My new invention succeeds in overcoming these disadvantages in the structure of the container. My container protects content temperatures, prevents "sloshing" of liquid thermal gel, and has temperature raising and temperature lowering capabilities. A safety pressure release is provided in my device to prevent container eruption from overheat or prolonged microwaving. My container being structured of machine washable and heat resistant microwaveable plastic is also an advantage over devices shown in past art patents.

SUMMARY OF THE INVENTION

In practicing my invention, I have provided both a structural arrangement and a confined thermal medium to produce a dual insulating and temperature modulating container having both heating and cooling capabilities. A commercially available thermal gel formulated for both hot and cold retention qualities, is permanently sealed within an inner chamber of the container which totally surrounds the cup liner holding the beverage. The container, as a unit, can be placed in the freezer for cooling beverages, or in a microwave or convection oven to be heated for warming them. My device not only maintains the contents at a desired temperature for prolonged periods, but can increase or decrease the temperature of the contents, cool a lukewarm soft drink, or heat coffee which is at room temperature. If just maintaining the contents of the container at a desired temperature is required, then my container can simply be left in the freezer, the refrigerator, or the oven for a shorter period of time. My device also contains a layer of closed cell insulating foam on the outer walls to prevent condensation forming on the surface of the container, and also to insulate the user's hands against the cold or heat of the contents. The interior structure of my invention contains baffles or partitions which are connected to the interior lining of the container and are designed to help dissipate or radiate the temperature of the gel to the inner cup lining and from there to the contents. These baffles also eliminate the noise and wave action caused when the medium is in a more liquid state, as when heated. The wave action, if not controlled, can actually produce an imbalance which could tip the container over in some situations. One purpose of this device is to provide a container having an appearance and feel more like a regular cup or mug without the noise and bulk of the previous inventions.

A second embodiment of my invention is provided in the form of a styrofoam can or bottle holder containing the same insulating gel medium. This device is used only for cooling the contents of the can or bottle and is not designed for heating purposes.

A third embodiment of my invention is an insulated container in the form of a pitcher. This embodiment has all the qualities and capabilities of the first embodiment but has a pouring spout structured into the top of the inner lining which enables the contents of the container to be easily poured. Smaller scale versions of the third embodiment can serve as cream pitchers with or without lids or can be used as gravy pitchers.

Therefore, it is a primary object of my invention to provide a beverage container with double walls encasing an insulating medium formulated with both heating and cooling capabilities with the container structured to withstand both heating and cooling applications.

Another object of my invention is to provide an insulated beverage container having a layer of heat resistant foam insulation in the wall structure to help eliminate the formation of condensation on the outer surface of the container.

A further object of my invention is to provide an insulated beverage container which shields the user's hands from the excessive temperature of the contents.

A still further object of my invention is to provide an insulated beverage container having internal baffles designed to negate wave action and noise of the gel which also helps to radiate the temperature of the gel to the contents of the container.

An even further object of my invention is to provide an insulated beverage container structured of a non-toxic thermoplastic material which is dishwasher safe and capable of being heated and frozen, withstanding a temperature range of −200 to 260 degrees celsius.

A still further object of my invention is to provide an insulated beverage container embodied in the form of a pitcher. Smaller versions of this embodiment serving as cream pitchers would prove especially useful in the restaurant business where the cream containers sit unrefrigerated for extended periods of time.

Further objects and advantages of my invention will prove evident with a reading of the specification and subsequent comparison with the numbered parts shown in the drawings.

DRAWING REFERENCE NUMBERS

Figure 1:
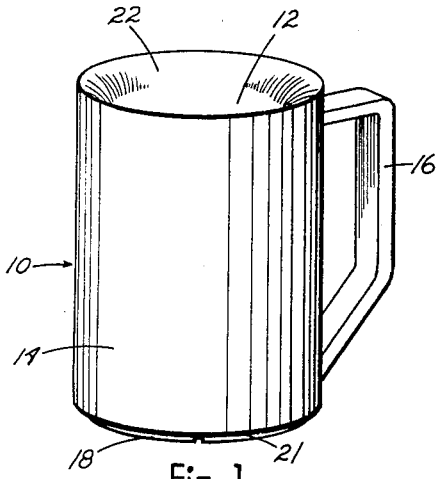
FIG. 1 is a perspective view of the preferred embodiment of the invention.

10 assembled insulated cup
12 tubular inner receptacle
14 tubular housing
16 cup handle
18 grooved cup base
20 partitioning baffles
21 flat bottom end
22 flanged lip
24 arched inner supports
26 flow space
28 styrofoam insulator sleeve
30 thermal gel
32 gel flow aperture
33 safety pressure release
34 assembled cold can holder
36 beverage can
38 can holder styrofoam shell
40 can holder cap
42 base legs
43 outer cylindrical wall
44 thermal gel compartment
45 inner cylindrical wall
46 gel compartment lid ring
47 circular plate
50 mold flow openings
52 outer mold form
54 inner mold form
56 mold form cap
58 foam flow arrows
60 can retainer lip
62 assembled insulated pitcher
64 pitcher inner lining
66 pitcher pour guide
68 pitcher handle
70 pitcher outer shell

DESCRIPTION OF THE PREFERRED EMBODIMENTS

Figure 2:
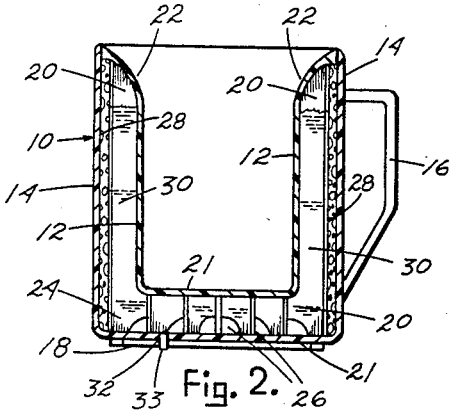
FIG. 2 is a sectional view showing the plastic foam insert, the cup inner lining, the thermal gel medium, and the partitioning baffles.

Referring now to the drawings at FIG. 1 where the preferred embodiment of the invention is illustrated in an assembled view. Assembled insulated cup 10, seen in FIG. 1, is comprised of tubular inner receptacle 12, a substantially cylindrical tube, closed at a flat bottom end 21 and having a flanged lip 22 at an opened top end, Tubular inner receptacle 12 has a plurality of inherently molded, partitioning baffles 20, shown in FIG. 4 A, attached longitudinally to the outer wall surface. Partitioning baffles 20 are substantially rectangular and the shorter sides project radially outward from the outer wall surface of tubular inner receptacle 12, the longer sides extending vertically from adjacently below the open outwardly beveled edge of flanged lip 22 at the top and somewhat passed the closed flat bottom end 21. The lower portion of partitioning baffles 20 extend downwardly passed the bottom of cup inner lining 12 and continue horizontally inward to the center of closed flat bottom 21, tapering toward, and attaching to one another in the center forming arched inner supports 24. The open area created by arched inner supports 24 form flow space 26, as illustrated in FIG. 2 for thermal gel 30 to flow through. As shown in FIG. 4 C, tubular housing 14 is also a cylindrical tube closed at the bottom end and opened at the top end, having vertically attached to its outer side surface, cup handle 16, which is either adhesively attached to the finished device or molded in one piece with tubular housing 14. Tubular housing 14 has molded into the closed, bottom surface, grooved cup base 18 which serves as a support base, shown in FIG. 1 and FIG. 4 C. Grooved cup base 18 is designed to allow air circulation through one or more apertures located along the bottom edge, preventing a vacuum seal between grooved cup base 18 and the surface it rests on. Both tubular housing 14 and tubular inner receptacle 12 are composed of polytetrafluoroethylene or similar thermoplastic material having a temperature variant of −200 to 260 celsius. Styrofoam insulator sleeve 28, seen in FIG. 4 B, is a cylindrical open-ended tube comprised of hot and cold resistant foam insulation having a temperature operating range compatible with that of tubular housing 14, and is used to keep the outer wall of the cup from becoming uncomfortably hot. The outside diameter of plastic foam insert 28 is sized to fit tightly within the inside diameter of tubular housing 14 to form a liquid-tight seal between the two walls. The interfaced wall of styrofoam insulator sleeve 28 has a liquid proof surface to keep thermal gel 30 from reaching the inner side walls of tubular housing 14 and transferring heat. Thermal gel 30, a commercially available thermal gel having a low expansion coefficient and both hot and cold retention qualities, is contained within assembled insulated cup 10 between partitioning baffles 20 and plastic foam insert 28 as shown in FIG. 2. Tubular inner receptacle 12 is permanently attached to tubular housing 14 on their upper edges and bottom surfaces by adhesive means. Other techniques such as crimping, heat sealing, or sonic bonding may be used to permanently attach the two units with an airtight and leakproof seal. A hollow space is created in assembled insulated cup 10 between tubular inner receptacle 12 and plastic foam insert 28, around partition baffles 20, through flow space 26, and the bottom edge of tubular housing 14, all of which form the compartment for thermal gel 30, shown in FIG. 2 and 3.

Figure 3:
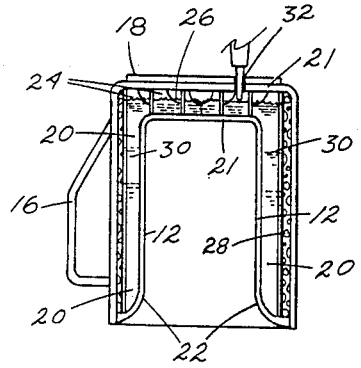
FIG. 3 shows a suggested method for introducing the insulation medium into the device, which is done after the container is assembled, via a small aperture made into the bottom of the container.
Figure 4:
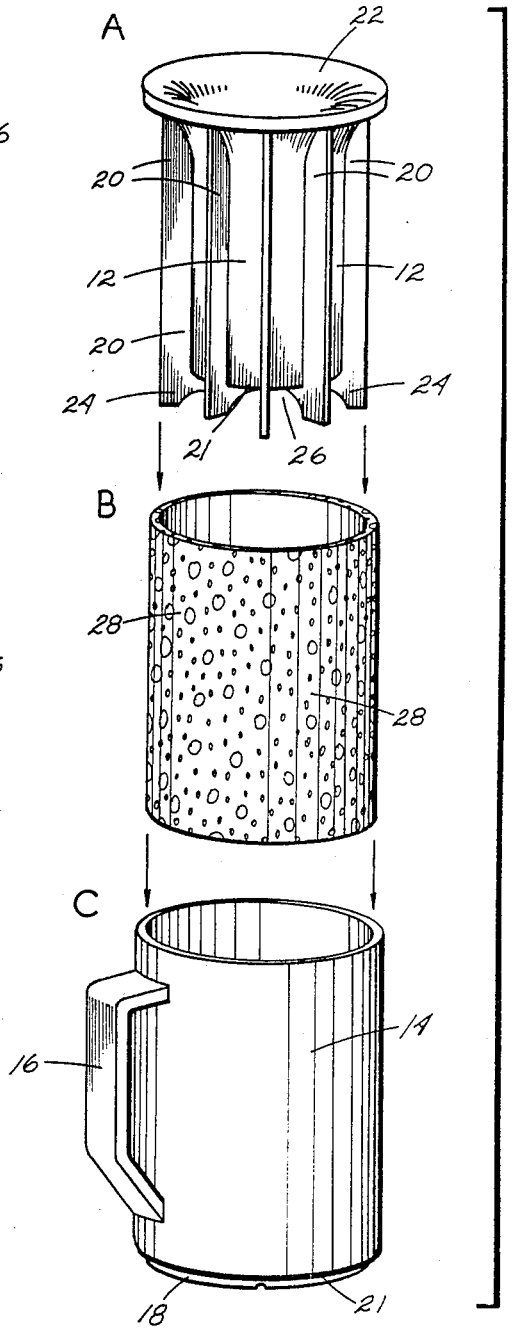
FIG. 4 is a perspective, exploded view of the invention showing at A the cup inner lining which holds the beverage, at B the plastic foam insert, and at C the cup outer shell.

Thermal gel 30 is introduced into the assembled insulated cup 10, leaving sufficient air space to compensate for expansion, through thermal gel flow aperture 32 which is located on the bottom surface, as shown in FIG. 3. Gel flow aperture 32 is sealed afterward to prevent leakage of thermal gel 30 by safety pressure release 33. Safety pressure release 33 functions as a safety release vent if the user inadvertently over heats the device to an extreme temperature, causing pressure to build up. Safety pressure release 33 would then be ejected from gel flow aperture 32 long before the cup housing would shatter, releasing the pressure and preventing container eruption and possibly injury. Safety instructions and temperature ranges are provided with the device, but the wide temperature range capabilities of thermal gel 30 along with that of the plastic with which assembled insulated cup 10 is manufactured, makes the danger of an occurrence such as this almost impossible. Thermal gel 30 can also be poured into tubular housing 14 after installation of plastic foam insert 28, and prior to installation of tubular inner receptacle 12.

Figure 5:
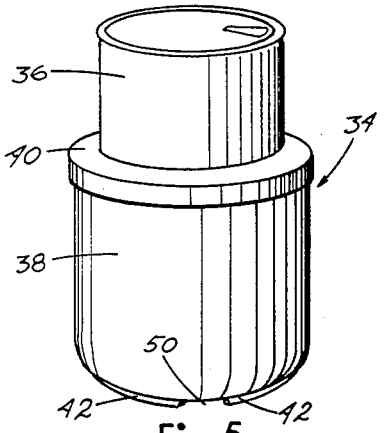
FIG. 5 is a perspective drawing illustrating the second embodiment of the invention comprising an insulated styrofoam bottle or can holder.
Figure 6:
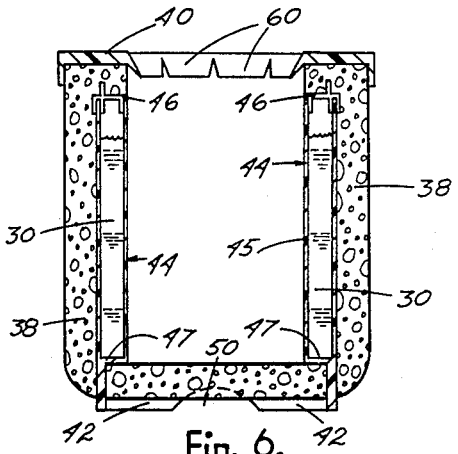
FIG. 6 is a sectional view of the second embodiment showing the can holder styrofoam shell with an interior compartment containing the refrigerant thermal gel.
Figure 7:
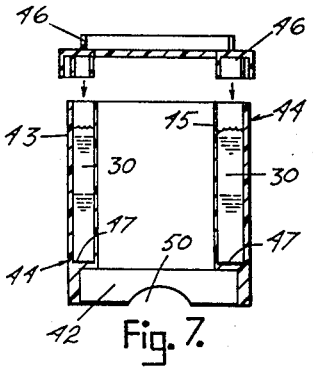
FIG. 7 is a sectional view of the thermal gel compartment and gel compartment lid ring of the second embodiment.
Figure 8:
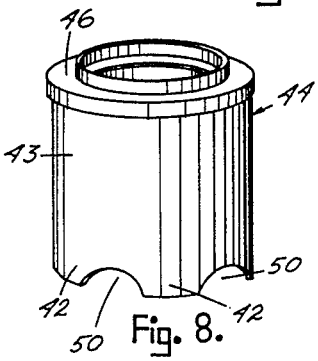
FIG. 8 shows a perspective view of the assembled thermal gel compartment depicting the structure of the base legs of the second embodiment.
Figure 9:
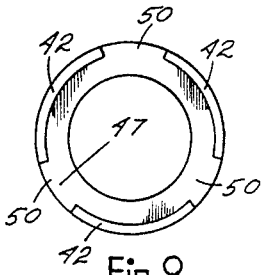
FIG. 9 is a bottom plan view of the thermal gel compartment showing the base legs, and the mold flow openings between the legs of the second embodiment.
Figure 10:
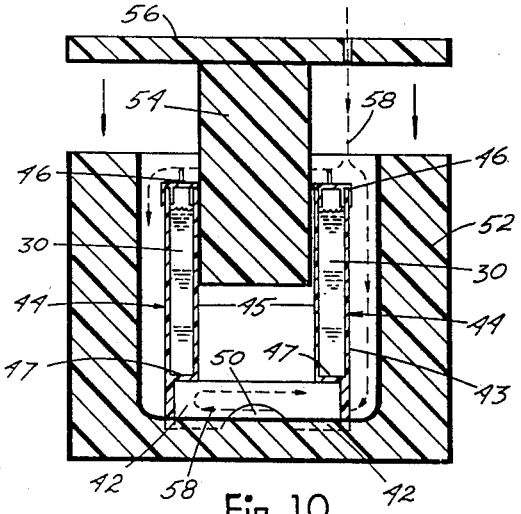
FIG. 10 illustrates the molding method and apparatus for forming the styrofoam around the thermal gel compartment of the second embodiment of the invention.
Figure 11:
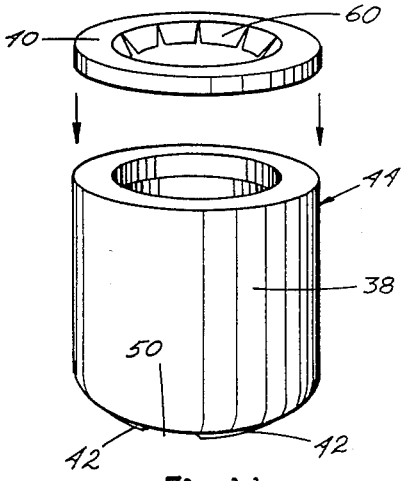
FIG. 11 is a perspective view of the thermal gel compartment and gel compartment lid with the styrofoam formed around it, showing part of the base legs of the unit extending out past the styrofoam to form legs.

A second embodiment of the invention is provided in the form of assembled cold can holder 34, as seen in FIG. 5 holding beverage can 36. Assembled cold can holder 34 is designed strictly as an insulated refrigerant container for the purpose of holding bottles and cans. The outer portion of assembled cold can holder 34 is comprised of can holder styrofoam shell 38, can holder cap 40, and base legs 42, all seen in FIG. 5. The interior of assembled cold can holder 34 contains thermal gel compartment 44 which is comprised of two vertically positioned, concentric, opened ended, cylindrical walls, the outer cylindrical wall 43 being longer on the bottom edge, illustrated in the sectional view of FIG. 7. The second wall, inner cylindrical wall 45, is permanently connected, on its bottom edge, to the outer cylindrical wall 43 with a horizontally positioned circular plate 47 which forms a common floor between the two cylindrical walls. The longer, downwardly extended portion of the larger outer cylindrical wall 43 forms on its lower edge holder base legs 42. Located on the lower edge of base legs 42 are three semicircular notches comprising mold flow openings 50, better seen in FIG. 8. Thermal gel compartment 44 is filled, shown in FIG. 7, on its open upper end, with thermal gel 30, and permanently sealed with gel compartment lid ring 46, leaving sufficient space for expansion. Gel compartment lid ring 46 has an upwardly extending center circular ridge which helps to hold thermal gel compartment 44 within can holder styrofoam shell 38, helping to prevent separation of the two units due to everyday wear and tear. Can holder styrofoam shell 38 is permanently formed around thermal gel compartment 44 with an injection styrofoam molding process utilizing foam molds, illustrated in FIG. 10. The assembled thermal gel compartment 44 is placed within the larger sized cavity of outer mold form 52 having a portion of base legs 42 retained within the bottom of the mold, serving as a base support after molding. Inner mold form 54, sized to insert into the interior of thermal gel compartment 44, extends to the top of base legs 42. The top portion of inner mold form 54 is attached to mold form cap 56 which fits over and seals the compartment formed by outer mold form 52. Styrofoam is injected into the cavity of the mold through an aperture in the top surface, as seen in FIG. 10, where foam flow arrows 58 show how the styrofoam is distributed around thermal gel compartment 44. After molding, thermal gel compartment 44 is then permanently affixed with can holder styrofoam shell 38, leaving the inside portion of thermal gel compartment 44 exposed on the interior wall surface and on the bottom edge with a short section of base legs 42. This unit is now permanently affixed along the top surface with can holder cap 40. The inner top edge of can holder cap 40 is a downwardly beveled serrated edge which forms can retainer lip 60. Can holder cap 40, shown in FIG. 11, with can retainer lip 60 helps to retain beverage can 36 within the holder and also helps decrease wear and tear on the top of can holder styrofoam shell 38.

Figure 12:
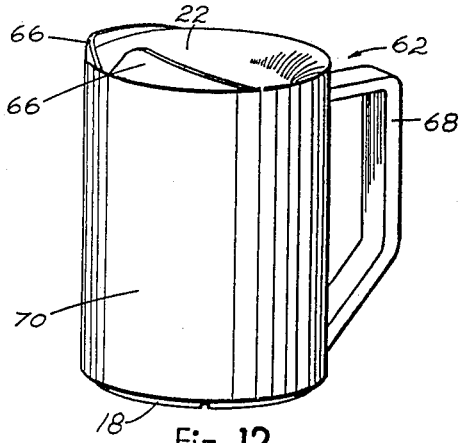
FIG. 12 illustrates a third embodiment of the invention as a pitcher with a pitcher pour guide.
Figure 13:
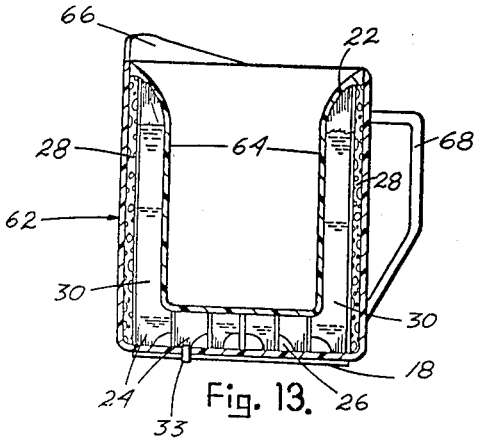
FIG. 13 is a sectional view of the third embodiment of my invention.
Figure 14:
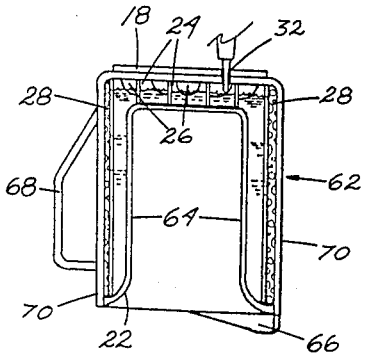
FIG. 14 shows the suggested procedure for introducing the insulating medium into the pitcher.
Figure 15:
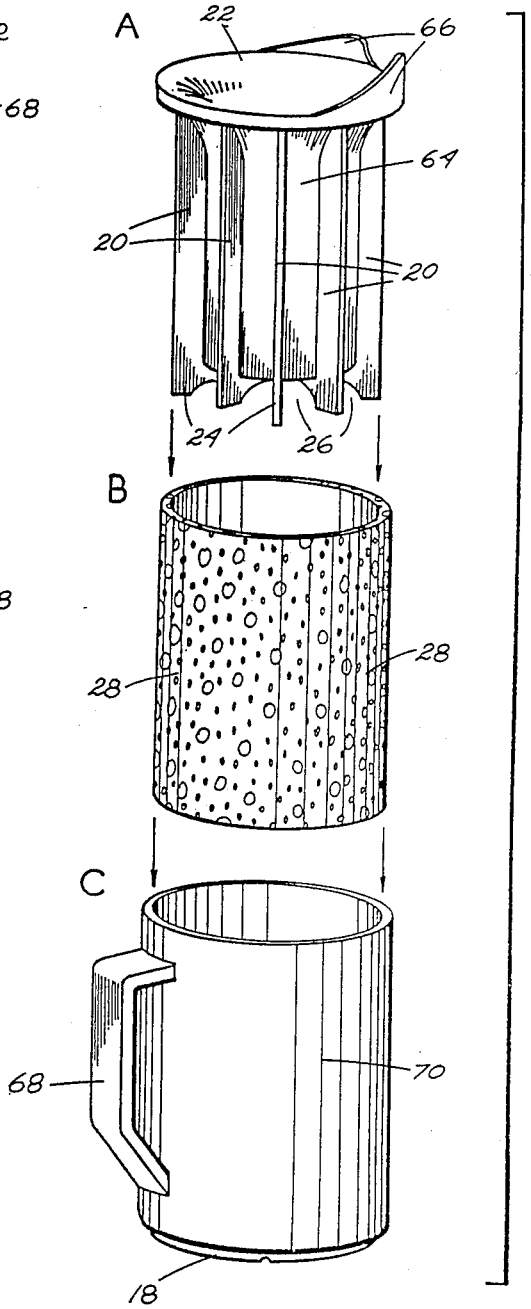
FIG. 15 is an exploded, perspective view of the third embodiment, where A depicts the pitcher inner lining with attached pour guide, B depicts the plastic foam insert, and C is the pitcher outer shell.

A third embodiment of my invention, as shown in FIG. 12, is furnished with the same features and design as assembled insulated cup 10, but is provided in the form of assembled insulated pitcher 62. The only adjustment, other than variations in size, is made to pitcher inner lining 64, seen in FIG. 15 A, which has pitcher pour guide 66 permanently attached to the upper edge of beveled lip 22 adjacent to pitcher handle 68. Pitcher outer shell 70, shown in FIG. 12 and 15, remains the same in design as tubular housing 14, but may vary greatly in size. The pitchers may range in dimensions from small cream pitchers to large volume beverage pitchers. An optional cap or lid can be provided for the pitcher embodiment to help retain the desired temperature.

Although I have described my invention in detail in the specification, it is to be understood that the drawings be considered only illustrative of the principals of the device. Therefore, modifications may be practiced in the invention which do not exceed the intended scope of the appended claims.

I claim:

1. an insulated beverage container with both heating and cooling capabilities comprising:

a. a single-walled tubular inner receptacle having an outwardly flanged opened end, and oppositely, a flat closed end; the orientation of said tubular inner receptacle being said outwardly flanged opened end upwardly as the top of said tubular inner receptacle, said flat closed end downwardly as the bottom of said tubular inner receptacle, and said wall vertically inclined, the outer surface of said vertically inclined wall affixed in vertical longitudinal alignment therewith by a multiple of substantially rectangular, spaced having the shorter sides of said baffles radiating outwardly from said outer wall surface beginning upwardly adjacently below said outwardly flanged open top end of said tubular inner receptacle and continuing downwardly along said outer wall surface somewhat beyond said flat closed bottom end of said tubular inner receptacle with said baffles, the downwardly terminal ends thereof, then extending inwardly beneath said closed bottom end of said tubular inner receptacle to connect to one another at the center thereof, the lower outer edges of said baffles shaped into support legs for said tubular inner receptacle and curved upwardly centrally to produce semicircular flow-passage arches;

b. a single-walled tubular housing structured to encase said tubular inner receptacle; said tubular housing having an opened end, and oppositely, a flat closed end, the orientation of said tubular housing being said opened end upwardly as the top of said tubular housing, said flat closed end downwardly as the bottom of said tubular housing, and said single wall vertically inclined; said vertically inclined wall sized for cooperative alignment with said tubular inner receptacle wall with a space therebetween with said baffles therein and having said flat bottom of said tubular housing paralleling said flat bottom of said tubular inner receptacle with a space therebetween with said downwardly terminal ends of said baffles therein, said lower outer edges of said bafiles as said support legs for said tubular inner receptacle resting against the inner surface of said bottom of said tubular housing;

c. a thin wall styrofoam insulator sleeve; said insulator sleeve of tubular configuration and sized for insertion into said space therebetween said vertically inclined wall of said tubular housing and said vertically inclined wall of said tubular inner receptacle with said insulator sleeve sufficiently thinned to fit snugly against the inner surface of said wall of said tubular housing and clear the outer edges of said baffles attached to said outside wall of said tubular inner receptacle; said styrofoam sleeve, the interfaced surface thereof, manufactured with a liquid blocking finish protective of said styrofoam which is cellar on the outer side against the interfaced side of said vertically inclined wall of said tubular housing;

c. a permanently sealing means attaching the outside edge of said flanged lip of said top of said tubular inner receptacle to the interfaced surface immediate said top of said vertically inclined wall of said tubular housing with said tubular housing encasing said styrofoam sleeve and said tubular inner receptacle with said baffles in said wall spaces formed between said vertically inclined walls of said inner receptacle and said housing and said space between paralleling said bottoms thereof, with said spaces formed between said walls and said bottoms with said baffles therein being a chamber for containment of a thermal gel solution;

d. a liquid thermal gel composition formatted to withstand a cooling environmental condition of −200 celsius and a heating environmental condition of 260 celsius with said thermal gel capable of remaining cooled or heated for extended periods of time away from mechanical cooling and heating sources and being capable of radiating heat or cold to wall surfaces of a confining chamber.

e. said liquid thermal gel confined in said chamber formed by said vertically inclined wall of said tubular inner receptacle and said vertically inclined wall of said tubular housing and said paralleling bottoms thereof, there being sufficient open space in said chamber between said and said flow-passage arches in said downwardly and inwardly ends of said baffles to allow circulatory movement within said chamber of said thermal gel when said thermal gel is sufficiently liquified to reposition;

f. access means for introducing said liquid thermal gel into said chamber;

g. a safety pressure release means activated by pressure applied from inside said chamber to a pressure sensitive fixture having predetermined pressure releasing mechanics.

2. The insulated beverage container of claim 1 wherein said access means for introducing said liquid thermal gel into said chamber is a plugged insertion aperture in said flat bottom of said tubular housing.

3. The insulated beverage container of claim 1 wherein said liquid thermal gel is inserted into said chamber through said top of said tubular housing prior to adhering said flanged lip of said top of said tubular inner receptacle to said wall of said tubular housing.

4. The insulated beverage container of claim 1 wherein said safety pressure release means is the plug in said plugged insertion aperture for introducing said liquid thermal gel into said chamber, said plug structured of a material sufficiently softer than the material of said insulated beverage container to release before said beverage container can erupt.

5. The insulated beverage container of claim 1 wherein said thin wall styrofoam insulator sleeve is means for preventing the exterior surface of said vertically inclined wall of said tubular housing from becoming hot, cold, or moist through radiation of content moisture, or the temperature of said container content.

6. The insulated beverage container of claim 1 wherein said tubular housing has a handle affixed to said outer surface of said outer vertically inclined wall.

7. The insulated beverage container of claim 1 wherein said tubular inner receptacle has a permanent pour spout attached to the upper edge of said flanged lip and said handle is aligned vertically on an opposite side in said outer surface of said vertically inclined wall of said tubular housing producing a pitcher-like embodiment of said insulated beverage container with said pitcher-like embodiment variously sized and shaped.

8. The container of claim 1 wherein said tubular housing and said tubular inner receptacle are manufactured of material including thermoplastics capable of withstanding a variation of -200 to 260 degrees Celsius.

9. An insulated cold beverage can or bottle holder comprising:

a. an inner plastic compartment structured as two vertically oriented concentric inner and outer cylindrical walls permanently attached to one another by horizontal communicating top and bottom ends, said outer cylindrical wall slightly longer than said inner cylindrical wall and containing three equidistance semicircular notches located on the bottom edge thereof, said inner plastic compartment having a permanently sealed inner chamber;

b an outer insulating foam sheath, said foam sheath formed around the outside wall and said communicating top end of said inner plastic compartment leaving a short section on the bottom edge of said outer cylinder exposed;

c. a circular plastic cap having a downwardly beveled inner edge, said inner edge having a multiple of equidistance notches;

d. a cold retaining medium, said cold retaining medium internally and permanently disposed within said inner plastic compartment.

10. The insulated cold beverage can or bottle holder of claim 9 wherein said cold retaining medium is a thermal gel formulated for cold retention qualities interposed in said inner plastic compartment.

* * * * *